US006095333A

United States Patent [19]

Bertrand

[11] Patent Number: 6,095,333

[45] Date of Patent: Aug. 1, 2000

[54] CHILD SAFETY BUCKET

[75] Inventor: Victor J. Bertrand, Ile Bizard, Canada

[73] Assignee: Ritvik Holdings Inc., Quebec, Canada

[21] Appl. No.: 08/393,539

[22] Filed: Feb. 23, 1995

[51] Int. Cl.[7] ..... B65D 21/036; B65D 25/28

[52] U.S. Cl. ..... 206/505; 206/508; 206/510; 220/318; 220/756; 220/759; 220/764; 220/770; 220/773

[58] Field of Search ..... 206/505, 506, 206/510, 508; 220/756, 759, 760, 761, 762, 764, 767, 769, 770, 773, 775, 776, 354, 318, 317, 322, 315, 752; 16/115

[56] References Cited

U.S. PATENT DOCUMENTS

| | | | |
|---|---|---|---|
| 0,956,715 | 5/1910 | Meixner | 220/756 X |
| 1,105,440 | 7/1914 | Keen | 220/318 |
| 2,107,428 | 2/1938 | Sexton | 220/776 |
| 3,927,812 | 12/1975 | Winters et al. | 220/769 X |
| 4,754,874 | 7/1988 | Haney | 220/352 X |
| 4,822,314 | 4/1989 | O'Brian et al. | 206/216 X |
| 5,044,513 | 9/1991 | Van Berne | 220/773 X |
| 5,050,760 | 9/1991 | Garcia | 220/773 X |
| 5,392,945 | 2/1995 | Syrek | 220/326 X |

FOREIGN PATENT DOCUMENTS

| | | |
|---|---|---|
| 2 142 363 | 8/1971 | Germany . |
| 373007 | 5/1932 | United Kingdom . |
| 92/06013 | 4/1992 | WIPO . |

*Primary Examiner*—Allan N. Shoap
*Assistant Examiner*—Niki M. Eloshway
*Attorney, Agent, or Firm*—Michael D. Bednarek; Crowell & Moring LLP

[57] ABSTRACT

A bucket that children cannot put over their head, having a bottom wall, side walls, a removable lid and a non-pivoting U-shaped handle. The side walls project upwardly from the bottom wall and form an opening having circumscribing edges. The removable lid fits in the circumscribing edges for closing the bucket. The non-pivoting U-shaped handle has opposite side legs slidably mounted onto the side walls. The U-shaped handle also has stopping means for limiting sliding of the handle between a first position where the U-shaped handle bears against the lid when the same is fitted in the circumscribing edges and a second position where the U-shaped handle extends away from the lid and thus makes it possible to remove the lid from the circumscribing edges. Thus, the U-shaped handle, both in first and second positions, divides the opening into two smaller openings which are smaller than a child's head, thus children cannot put the bucket over their head.

20 Claims, 8 Drawing Sheets

CHILD SAFETY BUCKET

BACKGROUND OF THE INVENTION a) Field of the Invention

The present invention is concerned with a bucket that children cannot put over their head, and more precisely with a bucket for use in putting away toy construction blocks.

b) Brief Description of the Related Art

It is well known that children hurt themselves everyday even with simple objects. For example, a storage bucket can be dangerous when a child puts it over his head since it can get stuck on it. In order to reduce the danger, Interlego A.G. has developed and presently sells a bucket having a transversal central panel which reduces the opening of the bucket and thus prevents accidents. The drawback of this central panel is that it reduces considerably the storage space in the bucket.

SUMMARY OF THE INVENTION

The object of the present invention to provide a bucket which is simple to manufacture, which would be stackable, and which has a reduced opening so that children cannot put it over their head, while offering as much storage space as regular buckets.

According to the present invention, the above object is achieved with a bucket that children cannot put over their head. The bucket comprises:

a bottom wall;

side walls projecting upwardly from the bottom wall and forming an opening having circumscribing edges;

a removable lid fitting in the circumscribing edges for closing the bucket; and a non-pivoting U-shaped handle having opposite side legs slidably mounted onto the side walls and stopping means for reducing sliding of the handle between a first position where the U-shaped handle bears against the lid when the same is fitted in the circumscribing edges and a second position where the U-shaped handle extends away from the lid and thus makes it possible to remove the lid from the circumscribing edges, whereby the U-shaped handle both in first and second positions divides the opening into two smaller openings, thereby preventing children from putting the bucket over their head.

Preferably, the bucket further comprises blocking means for keeping still the U-shaped handle in the second position whereby easing removal of the lid.

Preferably also, when the bucket is for use in putting away toy construction blocks, the removable lid may have toy blocks coupling elements projecting outwardly therefrom and the bucket is made of plastic material.

Preferably also, the bucket further comprises a transversal recess in the bottom wall, and the handle is sized and shaped to fit into the transversal recess of another identical stackable bucket superposed onto the bucket, whereby the buckets are stackable.

BRIEF DESCRIPTION OF THE DRAWINGS

In order to impart full understanding of the manner in which this object and others are attained in accordance with the present invention, preferred embodiments thereof will be described hereinafter with reference to the accompanying drawings wherein.

In the following description and the drawings, the same reference numerals will refer to the same structural elements.

DESCRIPTION OF PREFERRED EMBODIMENTS

Figure 1:
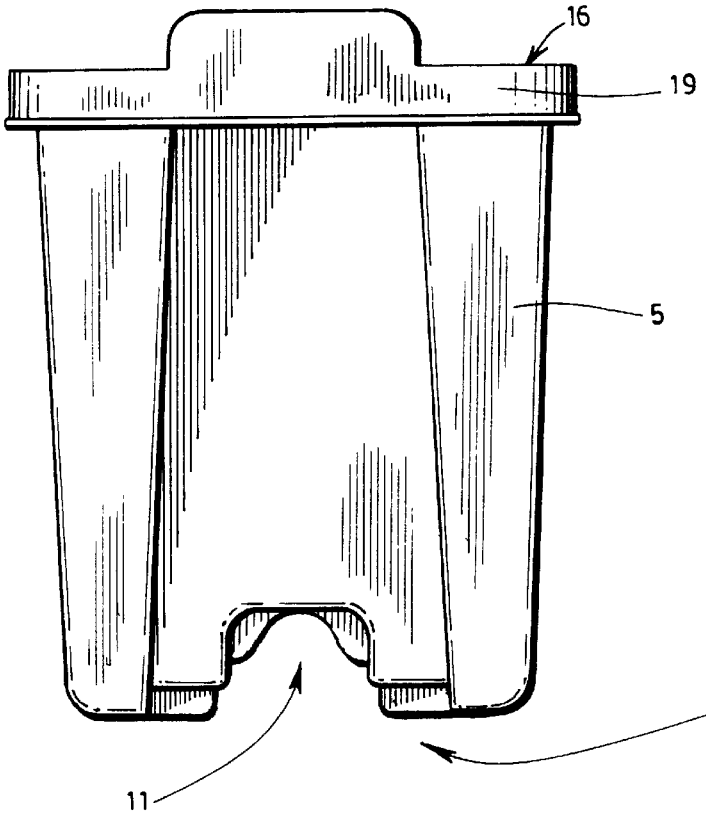
FIG. 1 is a side elevation view of a bucket made according to the invention, with lid and handle removed.
Figure 2:
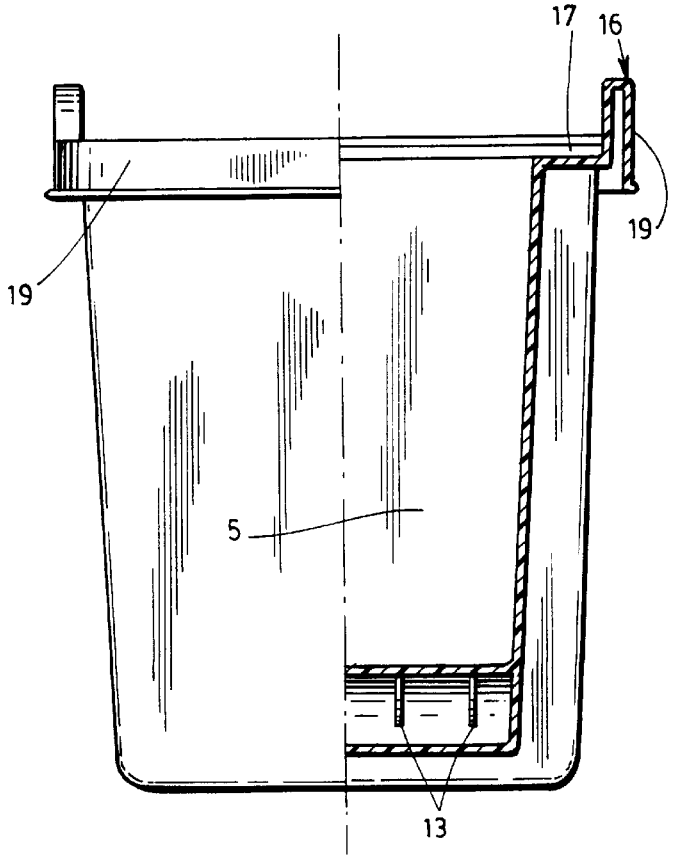
FIG. 2 is a partially cross section side elevation view of another side of the bucket of FIG. 1.
Figure 3:
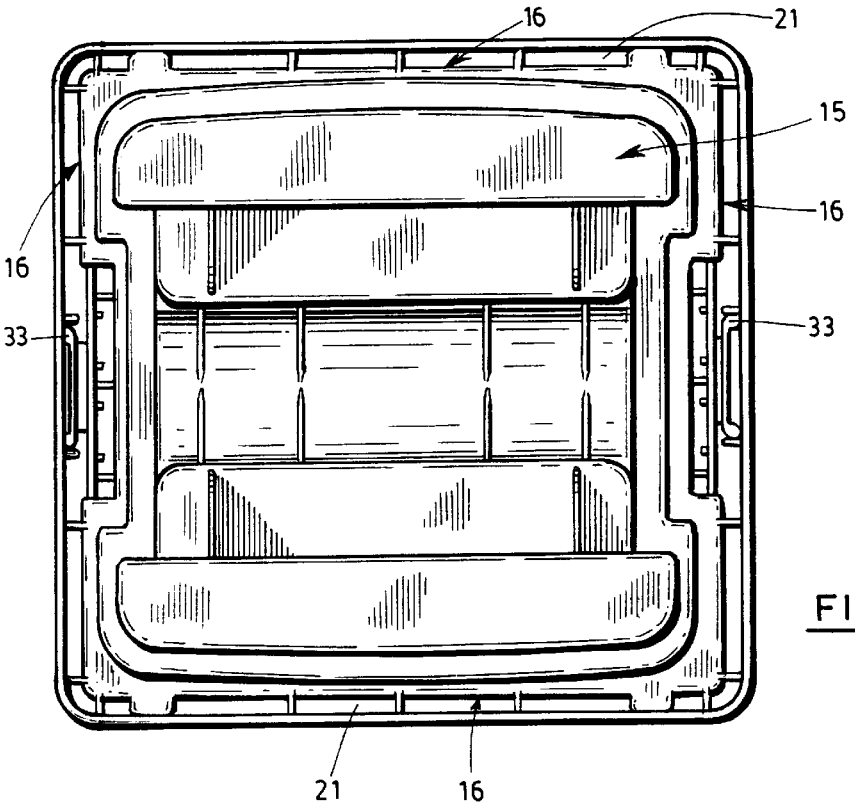
FIG. 3 is a top elevation view of the bucket of FIG. 1, with lid and handle removed.
Figure 4:
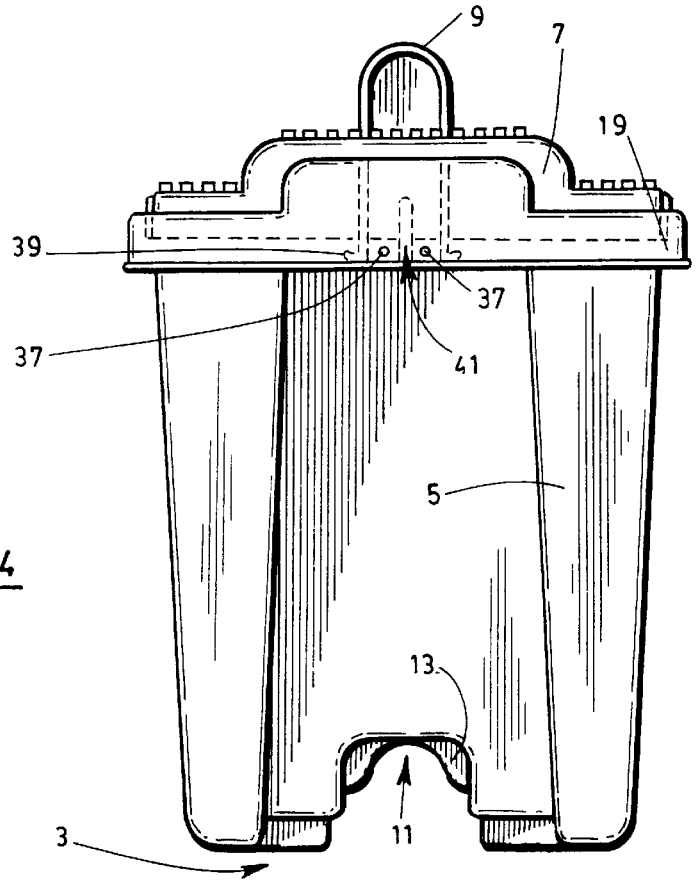
FIG. 4 is a partially cross section side elevation view of a bucket according to the invention.

Referring to FIG. 4, there is shown a stackable bucket 1 according to the present invention. The stackable bucket 1 has a bottom wall 3, a set of side walls 5, a removable lid 7 and a U-shaped handle 9. The side walls 5 project upwardly from the bottom wall 3 and form an opening 15 having circumscribing edges 16, as shown on FIGS. 1, 2 and 3. Each of the circumscribing edges 16 defines an inner flange 17 and an outer flange 19. As shown on FIGS. 1 to 7, the bottom wall 3, the side walls 5 and the inner and outer flanges 17 and 19 are tapered to lodge in other identical buckets, before the U-shaped handle is mounted.

Figure 9:
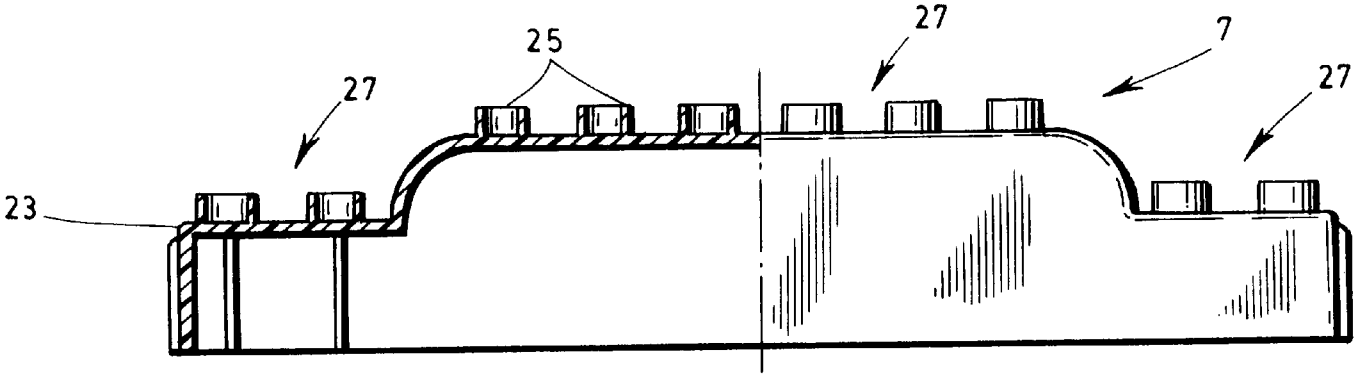
FIG. 9 is a partially cross section side elevation view of a lid according to a first preferred embodiment of the present invention.
Figure 10:
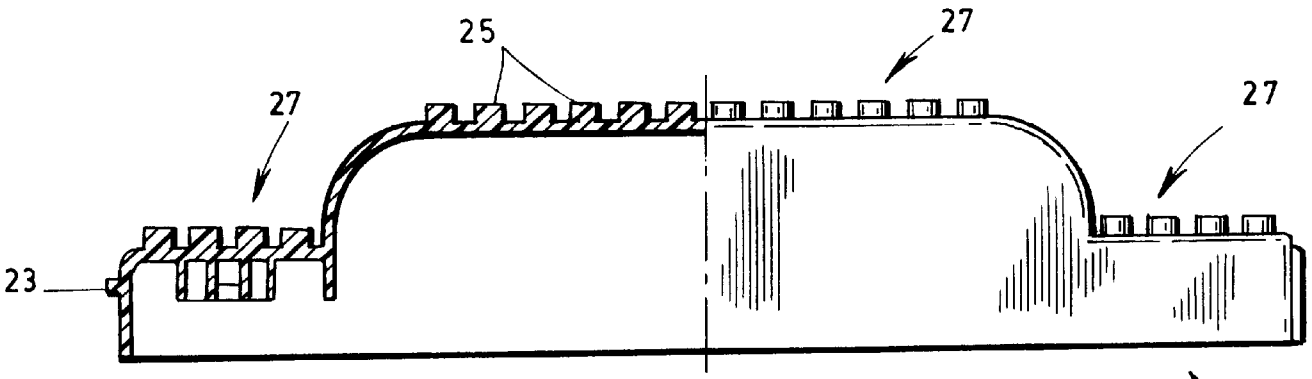
FIG. 10 is a partially cross section side elevation view of a lid according to a second preferred embodiment of the present invention.

Referring back to FIGS. 4 and 5, there is shown the removable lid 7. As shown, the removable lid 7 fits in the circumscribing edges 16, and more particularily in the inner flanges 17 defined by the circumscribing edges 16 which act as a support for the lid 7. For easing removal of the lid from the bucket, the lid 7 comprises a pair of opposing lips 23, shown on FIGS. 9 and 10 and each of the inner flanges 17 adjacent to the opposing lips 23 may further comprise two grasping recesses 21, and located so that the grasping recesses 21 are under the opposite lips 23. The opposite lips 23 and the grasping recesses 21 allow a user to insert his fingers between one opposite lip 23 and the grasping recess 21 underneath, to easily remove the lid 7 from the bucket.

Figure 8:
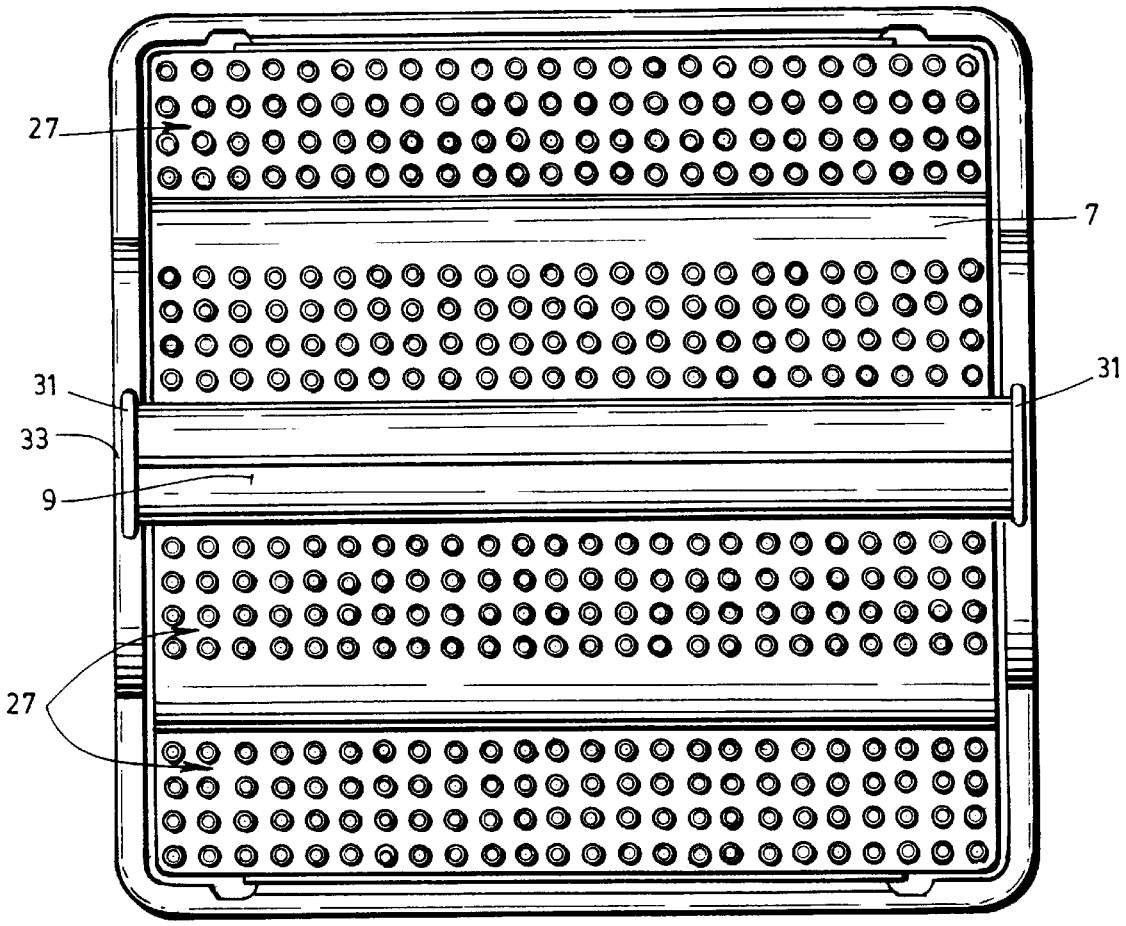
FIG. 8 is a top elevation view of a lid fitted in the circumscribing edges with a U-shaped handle pressed against it, according to the present invention.

When the bucket is used for putting away toy construction blocks, the removable lid 7 preferably has toy blocks coupling elements 25 that project outwardly therefrom and are shaped to receive small corresponding toy blocks (not shown). According to a first preferred embodiment of the invention, shown on FIGS. 8 and 10, the toy blocks coupling elements are small coupling elements, disposed in three strips 27. The exterior strips have four rows and twenty-four columns, and the middle strip has twelve rows and twenty-four columns. According to a second preferred embodiment of the invention, shown on FIG. 9, the toy block coupling elements are large coupling elements, disposed in three strips 27. The exterior strips have two rows and twelve columns and the middle strip has six rows and twelve columns. Whatever be the structure of the lid 7, the middle strip is progressively raised with respect to the exterior strips to avoid sharp edges, thus reducing danger for children.

Figure 5:
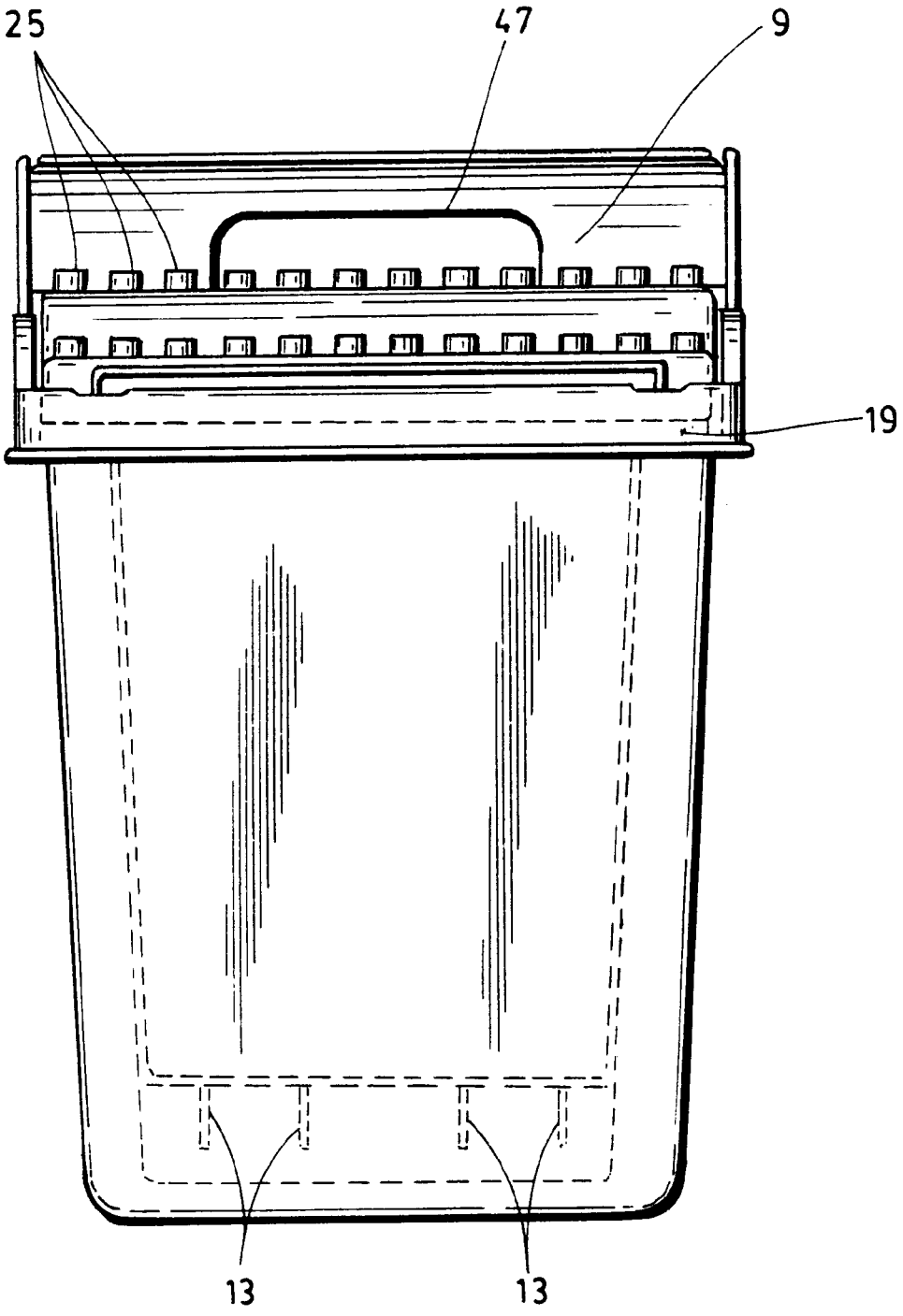
FIG. 5 is another partially cross section side elevation view of the bucket of FIG. 4.

In accordance with the invention, the bucket disclosed hereinabove is also provided with a non-pivoting U-shaped handle 9, shown on FIGS. 4, 5 and 11. The handle 9 has opposite side legs 31 slidably mounted onto opposite side walls 5, and more precisely in grooves 33 made through opposite outer flanges 19, shown on FIGS. 3 and 8. The grooves 33 are shaped to receive the legs 31 of the U-shaped handle 9.

Figure 6:
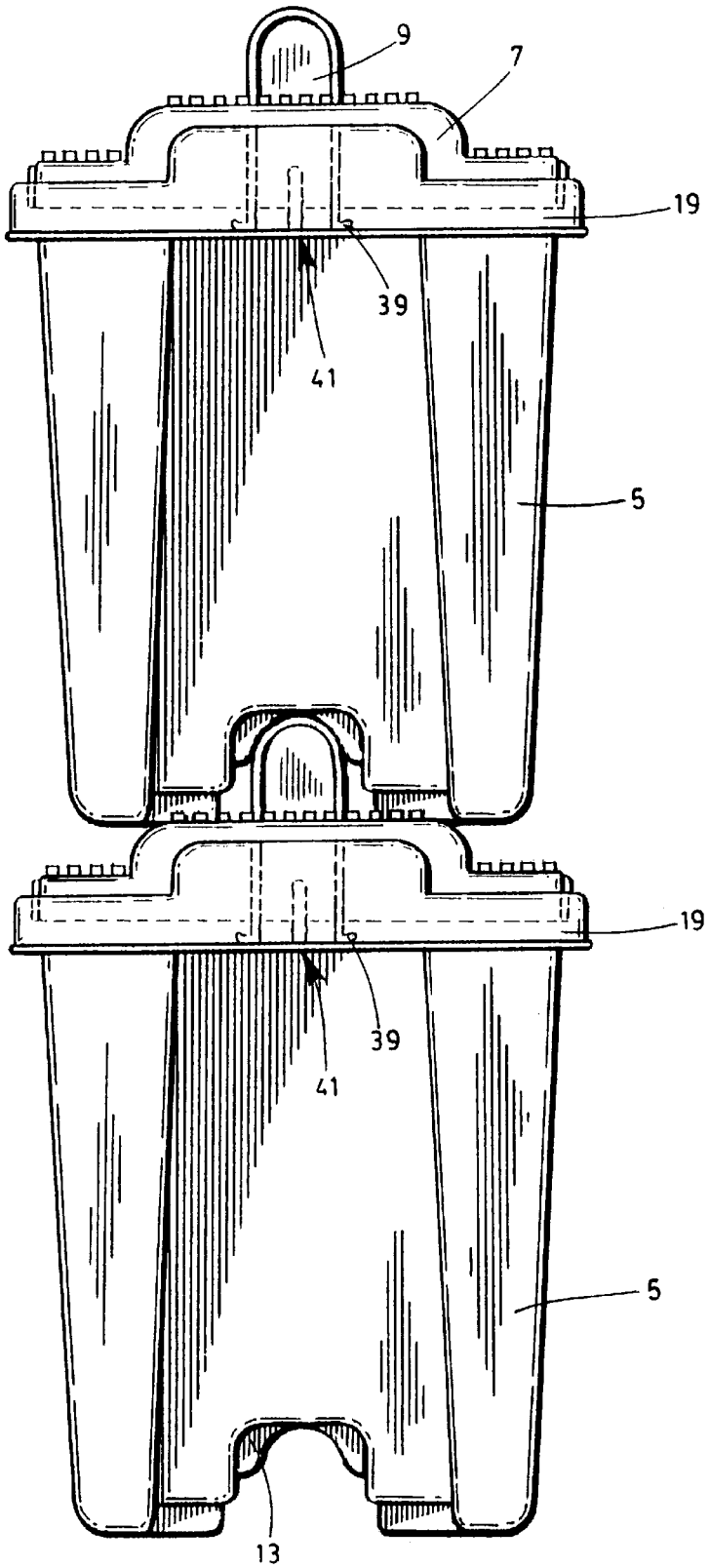
FIG. 6 is a side elevation view of the bucket of FIG. 4, onto which is superposed another identical bucket.

The handle 9 also has stopping means 39 for limiting sliding of the handle 9 between a first position, shown on FIGS. 4 and 6, where the U-shaped handle 9 bears against the lid 7 when the same is fitted in the circumscribing edges 16, and a second position (not shown) where the U-shaped handle 9 extends away from the lid 7 and thus makes it possible to remove the lid 7 from the circumscribing edges 16. The first and second positions of the handle 9 are determined in such a manner that the handle 7 constantly divides the opening 15 into two smaller openings. The two smaller openings are sized small enough so that a child cannot insert his head in the two smaller openings, thus prevents him from putting his head into the bucket where it could get stuck.

Figure 11:
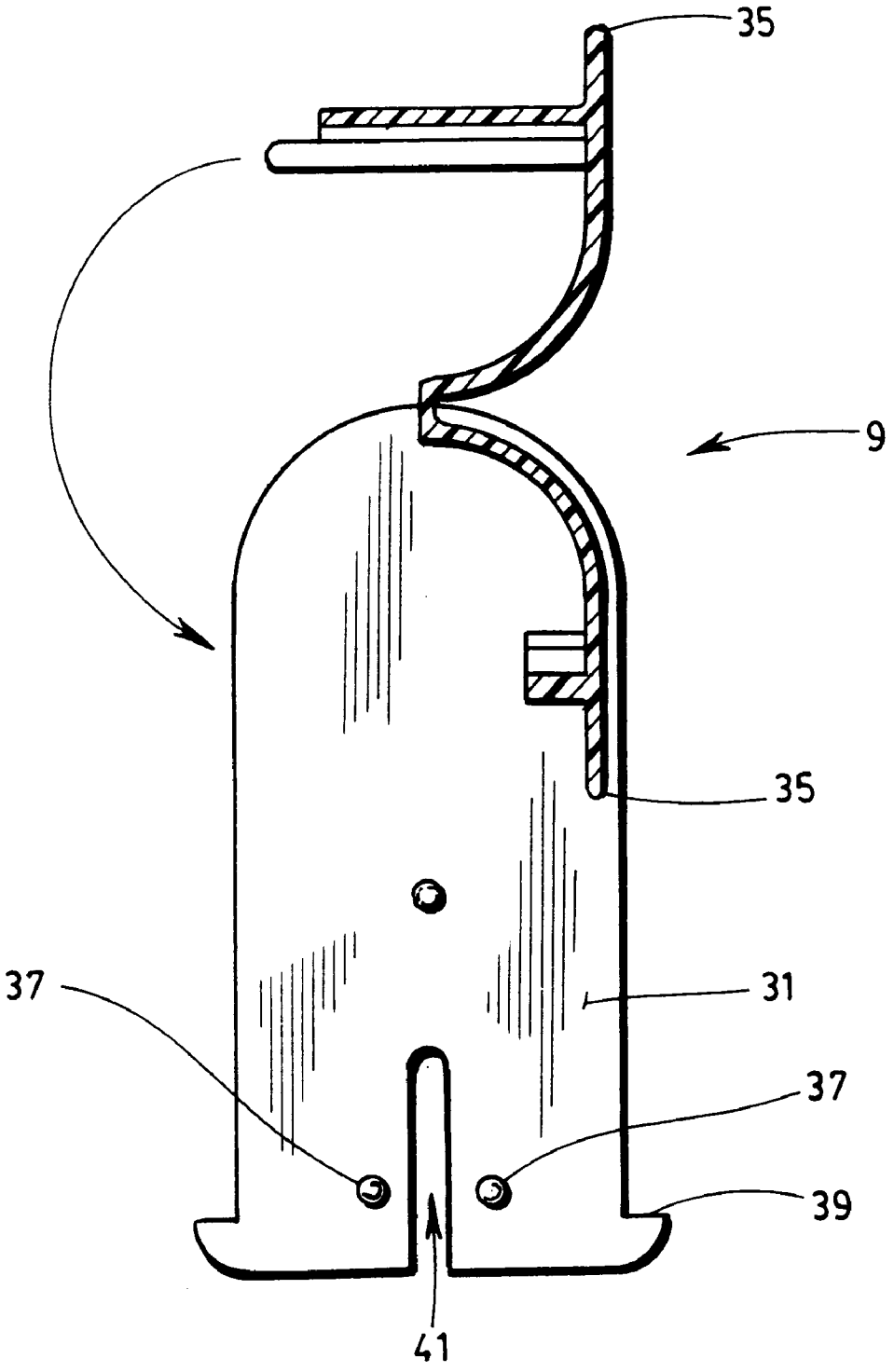
FIG. 11 is a side elevation view of a disassembled U-shaped handle according to the present invention.

The stopping means 39 are shown on FIGS. 4, 6 and 11. It consists, for example, of a pair of hooks at the extremity of each leg 31 of the U-shaped handle 9. The hooks point externally and make the extremities of the U-shaped handle 9 larger than the grooves 33, thus stopping the sliding of the U-shaped handle 9 in the second position. For easing insertion of the U-shaped handle 9 with stopping means 39 in the grooves 33, the U-shaped handle 9 further comprises, on each extremity of the legs 31 a central slot 41. By pressing the sides of the extremity of one of the legs 31, the central slot 41 therein allows reduction of the width of the leg 31 and its insertion in the corresponding groove 33.

Referring now to FIG. 11, which shows the handle 9 disassembled, it can be seen that once assembled, the handle 9 has a closed reversed half-elliptic cross section. It can also be seen that the handle has two ribs 35 downwardly projecting from the reversed half-elliptic cross section for fixing horizontally the handle 9 when the handle 9 is pressed against the lid 7. The two ribs are sized and shaped for tightly fitting between the toy blocks coupling elements 25 of the lid 7, thereby fixing horizontally the handle 9 when it is pressed against the lid 7.

The handle 9 further comprises blocking means 37 for keeping it still in the second position and easing removal of the lid 7. The blocking means 37 consists in at least one protruding button on each extremity of the legs 31 of the U-shaped handle 9. Thus, when the U-shaped handle 9 is slid in the grooves 33 and the protruding buttons exits the grooves 33, the U-shaped handle 9 is blocked in the second position, and a downward pressure is required to unblock it and let slide the handle 9 back in the first position. To allow greater stability of the U-shaped handle blocked in the second position, two protruding buttons are disposed in a line on each extremity of the legs 31. Other dispositions could be used as well.

For easing storage of the assembled buckets, each bottom wall 3 may be provided with a transversal recess 11, which is preferably defined by a series of stiffening ribs 13 and extends in the same plane as the handle, even though such is not compulsory. Then, the handle 9 is sized and shaped to fit into the transversal recess 11 of another identical stackable bucket superposed onto it, thus allowing stacking of the assembled buckets. Of course, it is preferable that the handle 9 fits under another stackable bucket only when in first position, in order to offer as much storage space in the bucket.

Figure 7:
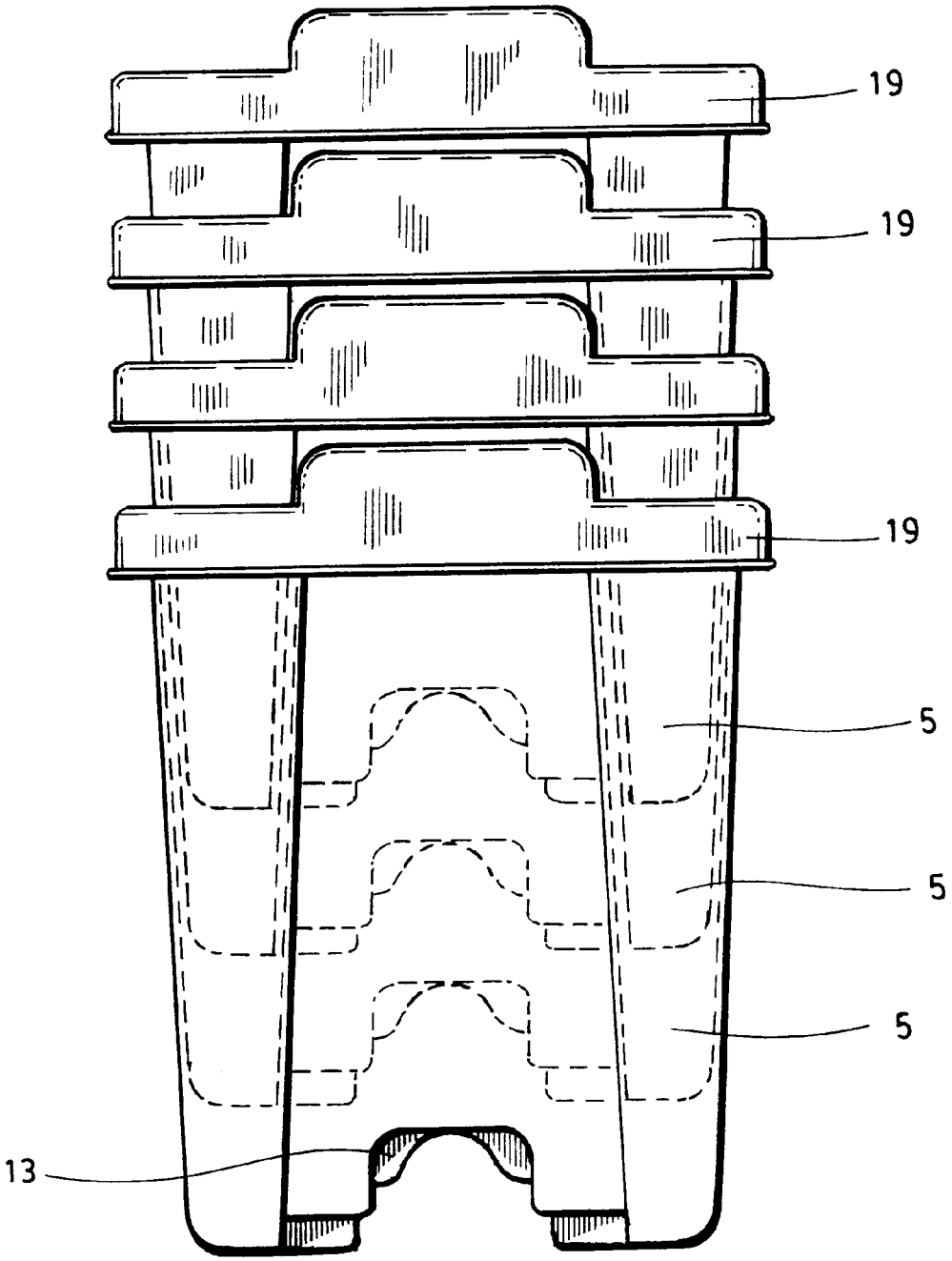
FIG. 7 is a side elevation view of buckets such as the one shown on FIG. 1, stacked.

Referring now to FIG. 7, there is shown a pile of stacked buckets, before the U-shaped handle 9 is installed and the lid 7 is fitted. The tapered shape of the bottom wall 3, side walls 5 and circumscribing edges 16 allow storage space saving when storing the disassembled buckets. Once assembled, as shown on FIG. 6, the buckets 1 are stacked so that the U-shaped handle 9 of the underneath bucket 1 fits in the transversal recess 11 of the superposed bucket 1. Of course, the shape of the transversal recess 11, bottom wall 3, side walls 5, lid 7, circumscribing edges 16 and U-shaped handle 9 could be modified, but according to a preferred embodiment of the invention, the bottom wall 3 is shaped to receive lids 7 having either sizes of toy block coupling elements 25, described hereinbefore.

To reduce danger for children, the outer flanges 19 of the circumscribing edges are preferably made wide enough to cover the extremities of the legs 31 of the handle, in both first and second positions, and the U-shaped handle 9 had a closed reversed half-elliptic cross section with a central grasping portion 47.

Whatever be the embodiment, the bucket is preferably made of a plastic material. In a preferable manner, the plastic material is rigid enough so that the bucket and all its components support the weight of a child.

Although the present invention has been explained hereinabove by way of preferred embodiments thereof, it should be pointed out that any modifications to these preferred embodiments, within the scope of the appended claims, are not deemed to change or alter the nature and scope of the present invention.

What is claimed is:

1. A bucket that children cannot put over their head, said bucket comprising:

a bottom wall;

side walls projecting upwardly from the bottom wall and forming an opening having circumscribing edges;

removable lid fitting in said circumscribing edges for closing said bucket;

a non-pivoting U-shaped handle having opposite side legs slidably mounted onto said side walls and stopping means for limiting sliding of the handle between a first position where said U-shaped handle bears against said lid when the same is fitted in the circumscribing wedges and a second position where said U-shaped handle extends away from said lid and thus makes it possible to remove said lid from the circumscribing edges, whereby said U-shaped handle both in first and second positions divides said opening into two smaller openings; and blocking means for keeping still the U-shaped handle in the second position thereby easing removal of the lid, wherein the circumscribing edges define inner flanges and outer flanges, the inner flanges acting as a support for said lid, and wherein the U-shaped handle is slidably mounted in grooves that are made through the outer flanges of the circumscribing edges and are shaped to receive the legs of the U-shaped handle.

2. The bucket of claim 1, wherein:

the stopping means consists in a pair of hooks at an extremity of each leg of the U-shaped handle, pointing externally and making the extremities of the legs of the U-shaped handle larger than the grooves, thereby stopping the sliding of the U-shaped handle in the second position;

the U-shaped handle further comprises, on each extremity of the legs, a central slot for allowing insertion of the legs of the U-shaped handle in the grooves by bringing closer sides of the slot; and the blocking means consists in at least one protruding button on each leg of the U-shaped handle whereby when the U-shaped handle is slid in the grooves and the protruding button exits the grooves, the U-shaped handle is blocked in the second position and a downward pressure is required to unblock it.

3. The bucket of claim 2, wherein, for easing removal of the lid from the bucket:

the lid further comprises a pair of opposite lips; and each of the inner flanges adjacent to one of the opposite lips is shaped to define a grasping recess, whereby in use, one can insert his or her fingers between one of the lips and the adjacent grasping recess for removing the lid from the bucket.

4. The bucket of claim 3, further comprising a transversal recess in said bottom wall, and wherein said handle is sized and shaped to fit into the transversal recess of another identical stackable bucket superposed onto said bucket, whereby said buckets are stackable.

5. The bucket of claim 4, wherein the bottom has a series of stiffening ribs defining the transversal recess.

6. The bucket of claim 5, wherein the transversal recess and the handle extends in a same plane.

7. The bucket of claim 5, for use in putting away toy construction blocks, wherein:

the removable lid has toy blocks coupling elements projecting outwardly therefrom; and the bucket is made of plastic material.

8. The bucket of claim 1, further comprising a transversal recess in said bottom wall, and wherein said handle is sized and shaped to fit into the transversal recess of another identical stackable bucket superposed onto said bucket, whereby said buckets are stackable.

9. The bucket of claim 8, wherein the bottom wall, the side walls and the circumscribing edges are tapered to lodge in another identical underneath bucket before the U-shaped handles are mounted.

10. The bucket of claim 8, for use in putting away toy construction blocks, wherein:

the removable lid has toy blocks coupling elements projecting outwardly therefrom; and the bucket is made of plastic material.

11. The bucket of claim 1, wherein the bottom wall, the side walls and the circumscribing edges are tapered to lodge in another identical underneath bucket before the U-shaped handles are mounted.

12. The bucket of claim 11, for use in putting away toy construction blocks, wherein:

the removable lid has toy blocks coupling elements projecting outwardly therefrom; and the bucket is made of plastic material.

13. The bucket of claim 1, for use in putting away toy construction blocks, wherein:

the removable lid has toy blocks coupling elements projecting outwardly therefrom; and the bucket is made of plastic material.

14. The bucket of claim 3, wherein the U-shaped handle has a closed reversed half-elliptic cross section with two ribs downwardly projecting therefrom, the ribs being sized and shaped for fitting between the toy blocks coupling elements of the lid thereby fixing horizontally said handle when it is pressed against the lid.

15. A bucket that children cannot put over their head, said bucket comprising:

a bottom wall;

side walls projecting upwardly from the bottom wall and forming an opening having circumscribing edges, a removable lid fitting in said circumscribing edges for closing said bucket;

a non-pivoting U-shaped handle having opposite side legs slidably mounted onto said side walls and stopping means for limiting sliding of the handle between a first position where said U-shaped handle bears against said lid when the same is fitted in the circumscribing edges and a second position where said U-shaped handle extends away from said lid and thus makes it possible to remove said lid from the circumscribing edges, whereby said U-shaped handle both in first and second positions divides said opening into two smaller openings;

wherein said bottom wall comprises a transversal recess and wherein said handle is sized and shaped to fit into the transversal recess of another identical stackable bucket superposed onto said bucket, whereby said buckets are stackable.

16. The bucket of claim 15, wherein the bottom wall, the side walls and the circumscribing edges are tapered to lodge in another identical underneath bucket before the U-shaped handles are mounted.

17. The bucket of claim 15, for use in putting away toy construction blocks, wherein:

the removable lid has toy blocks coupling elements projecting outwardly therefrom; and the bucket is made of plastic material.

18. A bucket that children cannot put over their head, said bucket comprising:

a bottom wall;

side walls projecting upwardly from the bottom wall and forming an opening having circumscribing edges;

a removable lid fitting in said circumscribing edges for closing said bucket;

a non-pivoting U-shaped handle having opposite side legs slidably mounted onto said side walls for movement between a first position where said U-shaped handle bears against said lid when the same is fitted in the circumscribing wedges and a second position where said U-shaped handle extends away from said lid and thus makes it possible to remove said lid from the circumscribing edges, whereby said U-shaped handle both in first and second positions divides said opening into two smaller openings; and wherein the circumscribing edges define inner flanges and outer flanges, the inner flanges acting as a support for said lid, and wherein the U-shaped handle is slidably mounted in grooves that are made through the outer flanges of the circumscribing edges and are shaped to receive the legs of the U-shaped handle.

19. The bucket of claim 18, wherein said bottom wall comprises a transversal recess and wherein said handle is sized and shaped to fit into the transversal recess of another identical stackable bucket superposed onto said bucket, whereby said buckets are stackable.

20. The bucket of claim 19, wherein the removable lid includes a plurality of cylindrical studs projecting outwardly therefrom so as to allow toy construction blocks to be secured to the lid.

* * * * *